US007549306B2

(12) United States Patent
Knecht et al.

(10) Patent No.: US 7,549,306 B2
(45) Date of Patent: Jun. 23, 2009

(54) PIECE DYEING BEAM

(76) Inventors: Felix Knecht, FOhrenstr. 10, CH-5542 Fislisbach (CH); Thomas Widmer, Mublenmattstr. 25, CH-6004 Luzern (CH)

( * ) Notice: Subject to any disclaimer, the term of this patent is extended or adjusted under 35 U.S.C. 154(b) by 631 days.

(21) Appl. No.: 10/967,337

(22) Filed: Oct. 19, 2004
(Under 37 CFR 1.47)

(65) Prior Publication Data

US 2006/0053841 A1 Mar. 16, 2006

(30) Foreign Application Priority Data

Oct. 21, 2003 (DE) ..... 103 49 406

(51) Int. Cl.
*D06F 17/02* (2006.01)

(52) U.S. Cl. ..... 68/189

(58) Field of Classification Search ..... 68/189
See application file for complete search history.

(56) References Cited

U.S. PATENT DOCUMENTS 3,916,653 A * 11/1975 West et al. ..... 68/15
4,581,906 A * 4/1986 Barriquand et al. ..... 68/15

* cited by examiner

*Primary Examiner*—Michael Barr
*Assistant Examiner*—Jason P Riggleman
(74) *Attorney, Agent, or Firm*—Kratz, Quintos & Hanson, LLP

(57) ABSTRACT

A beam dyeing machine has a beam in a vessel and is place in such a manner that it can be detached, which is equipped for acceptance of a wound structure or body made of textile products. An expansion and retrieval chamber is provided in the vessel in an area which is separated from the section of the vessel containing the beam with the wound structure/body.

12 Claims, 1 Drawing Sheet

PIECE DYEING BEAM

The invention relates to a piece dyeing beam with a vessel which can be closed and has a fabric beam placed in the vessel such that it can be withdrawn, which is equipped for placing a bound structure made of textile product, and has at least one perforated tube in the area of the circumference wall.

Such piece dyeing beams are known in the practice in different design forms. They serve the purpose of dyeing of sheet or ribbon-formed textile products wound in one or more windings next to each other on the beam, which generally is sprayed radially from the inside toward the outside with the processing liquor. The liquor, during the processing of the textile product, is led into a circuit including a circulation pump, which, where applicable, has a heat exchanger in order that the liquor temperature for the respective processing step can be adjusted as necessary.

From an auxiliary container connected to this liquor circuit, additives can be brought into the liquor circulation at specified time points during the course of the processing programme. In this context, normally these additives are chemicals that are available in watery solution or dispersion and therefore have to be brought into the circulation with a certain liquid quantity in the circuit.

The pressure proof vessel of the piece dyeing beam is designed wholly cylindrically as autoclave, and in the interest of simplifying the loading with the fully wound beam in a lying posture. Several treatments, particularly dyeing operations of the textile product, demand the total flooding of the vessel during the treatment, in order to exclude the effect of air-oxygen. Because of the fact that during the processing course volume alterations in the liquor occur, which is attributable to the process-dependent alterations of the liquor temperature and, where applicable, to the inclusion of processing additives from the auxiliary container, the vessel including the beam with the wound structure includes an expansion and retrieval chamber that is connected with the vessel through overflow pipes. In the piece dyeing beams known in the practice, this expansion and retrieval chamber is designed in the form of an inherently closed container, provided in the upper half of the vessel or placed directly on it. In this container, a certain liquor pattern is maintained, which ensures that the vessel during the processing is fully flooded and, at the same time, an undesirable pressure build-up in the vessel is prevented. In order to prevent air bubbles being found in the upper area of the vessel, the container representing the expansion and the retrieval chamber is connected with the vessel at least through one excess flow pipe, which branches out on the upper side of the vessel at two positions axially distanced from each other.

The placement of a boiler type container on a vessel that contains the product beam with the wound structure, calls for a significant roof height in the premises in which the beam dyeing machine can be located; it is also design-wise very expensive. Therefore the boiler type container, providing the expansion and retrieval chamber, is arranged adjacent to the vessel, which however, necessitates relatively long excess flow pipes and furthermore makes special precautions necessary, in order to prevent air bubbles from halting in the vessel upper part or in the excess flow pipes. Also, for space reasons, the arrangement of such a container beside the vessel is often not desirable.

Finally, it should also be mentioned that the liquor contained in the expansion and retrieval chamber must also be similarly circulated, in order to achieve the availability always of an identical concentration as far as possible, and in order to prevent the occurrence of deposits of chemicals or similar unhealthy substances. The known piece dyeing beams have, therefore, a device for maintaining an inherently limited liquor rotation circuit through the vessel inner space, the excess flow line devices and the expansion and retrieval chamber. Typically, in this restricted liquor circulation, proportionately somewhat the same quantity as in the total liquor quantity is circulated.

Proceeding from this state-of-the-art of technology, the invention focuses on the task to design a beam dyeing machine which exemplifies itself through a simple, transparent design with a price advantageous manufacturing possibility and through a lesser space requirement upper half of the vessel containing the beam with the wound structure.

For solving this problem, the beam dyeing machine as per the invention reference is made to the characteristics of the following embodiment 1: a beam dyeing machine with a vessel 1 that can be closed, one in which in the vessel the beam 5, positioned in a withdrawable manner, which is equipped for acceptance of a wound structure 6 made of textile products, and has at least one perforated tube in the area of its circumference.

a liquor expansion and retrieval chamber 13 which is connected with the inner space of the vessel through excess flow lines 22, and with a liquor circulation device consisting of a liquor circulation pump 15, which lies in a liquor circulation loop encompassing the textile beam 5 and the vessel interior.

a device (25, 26, 32) for maintaining a limited liquor circulation loop of its own through the inner space of the vessel, excess flow lines 22 and expansion and retrieval chamber 13 is thereby characterized that the expansion and retrieval chamber 13 is located directly in a section 13 of the vessel 1, separated from the section of vessel 12 containing the beam 5 with the wound structure 6.

In the new beam dyeing machine, the expansion and retrieval chamber is positioned directly in the vessel itself. Since all the hitherto required an additional container or boiler outside of the vessel containing the beam with the wound structure, a very simple transparent design of the entire Beam dyeing machine is obtained with a relativity lower space requirement.

In a preferred design form, the expansion and retrieval chamber is positioned in the vessel area separated from the vessel area containing the beam together with the wound structure, which for instance, can be achieved with a separation slab in the vessel. In this process, the expansion and retrieval chamber is arranged in axial direction of the vessel sideways adjacent to the vessel area containing the beam with the wound structure.

The excess flow line devices converging in the expansion and retrieval chamber are arranged generally on the vessel upper side branching from, and at least partially running outside of, the vessel. In principle, designs are possible in which the excess flow line devices similarly at least partially run in the vessel itself. In order to prevent the occurrence of vessel upper portion air bubbles in fully flooded vessels, where required, the excess flow line devices are jointed at least at two positions distributed over the axial length of the wound structure with the vessel interiors.

Depending upon the length of the wound structure, also several such taps distributed over the axial length of the wound structure can be visualized; often, however, even one single excess line device would be adequate. The liquor circulation circuit containing the liquor separation pump has connecting pipes branching from the vessel and connected to the perforated tube of the beam, jointed to the suction or discharge side of the circulation pump. In this process, the arrangement can be such that the liquor circulation pump is connected at the suction side with the connection pipes branching from the vessel and at the discharge side with the perforated tube of the beam, so that the wound structure operationally the liquor can flow radially from the inside to the outside. If the type of the processed textile products or the processing operation itself considers it as advantageous, also the connection devices leading to the vessel can be impinged with pressure through the liquor circulation pump, so that the liquor flows on the wound structure radially from the outside toward the inside. The reversal of the flow direction can be thus achieved that the liquor reversal devices in the circuit can be planned, or the liquor circulation pump can be equipped with the devices for altering its rotation direction, purposeful flaps etc. The limited liquor circulation circuit containing the expansion and retrieval chamber receives its own liquor conveying devices which in an advantageous design can include an injector, the injection nozzle of which remains connected with the discharge side of the liquor circulation pump, and the suction side is connected to the expansion and retrieval chamber. Alternatively, the conveying device can also include a pump.

Further designs and developments of the invention are as follows:

EMBODIMENT 2

Beam dyeing machine according to embodiment 1 is further characterized that the expansion and retrieval chamber is located in the axial direction of the vessel 1 sideways adjacent to the section of the vessel 12 containing the beam 5 together with the wound structure 6.

EMBODIMENT 3

Beam dyeing machine according to embodiment 2 is further characterized that the expansion and retrieval chamber is liquid-proof sealed from the vessel section 12 containing the beam 5 and the wound structure 6.

EMBODIMENT 4

Beam dyeing machine according to embodiment 3 is further characterized that the expansion and retrieval chamber is separated from the vessel section 12 containing the beam 5 and the wound structure 6 by means of a separation wall 15, which has at least one liquid passage.

EMBODIMENT 5

Beam dyeing machine according to embodiment 4 is further characterized that the expansion and retrieval chamber is traversed by a liquor line 14 jointed to the perforated tube of the beam.

EMBODIMENT 6

Beam dyeing machine according to one of the above mentioned embodiments is further characterized that the excess flow line devices (22, 23) are arranged such that they branch from the upper side of the vessel.

EMBODIMENT 7

Beam dyeing machine according to embodiment 6 is further characterized that the excess flow line devices (22, 23) are arranged such that at least partially they run outer half of the vessel 1.

EMBODIMENT 8

Beam dyeing machine according to embodiment 6 or 7 is further characterized that the excess flow line devices (22, 23) are connected to the interior of the vessel at least two positions distributed over the axial length of the wound structure.

EMBODIMENT 9

Beam dyeing machine according to one of the above mentioned embodiments is further characterized that the liquor circulation loop including the liquor circulation pump 15 is provided with a heat exchanger 36 for influencing the temperature of the circulated liquid.

EMBODIMENT 10

Beam dyeing machine according to one of the above mentioned embodiments is further characterized that the liquor circulation loop containing the liquor circulation pump 15 includes line devices 14 branching from the vessel 1 (16 and 17) and connected with the beam, which is connected to the suction or discharge side of the circulation pump 15.

EMBODIMENT 11

Beam dyeing machine according to embodiment 10 is further characterized that the liquor circulation pump 15 is connected at the suction side with the line devices 16 branching from the vessel 1 and at the discharge side with the beam 5, and that operationally the liquor flows on the wound structure 6 radially from inner to the outer.

EMBODIMENT 12

Beam dyeing machine according to embodiment 10 is further characterized that the line devices 16 going into the vessel 1 are impinged with pressure through the liquor circulation pump 15, and the liquor flows on the wound structure 6 radially from outer to the inner.

EMBODIMENT 13

Beam dyeing machine according to one of the above mentioned embodiments is further characterized that the liquor circulation loop encompassing the expansion and retrieval chamber contains liquor transport/conveyance devices 26.

EMBODIMENT 14

Beam dyeing machine according to embodiment 13 is further characterized that the liquor transport devices include an injector 26, the injection nozzle 27 of which remains connected with discharge side of the liquor circulation pump 15 and is connected at the suction side to the expansion and retrieval chamber.

EMBODIMENT 15

Beam dyeing machine according to embodiment 12 is further characterized that the transport device includes a pump.

BRIEF DESCRIPTION OF THE DRAWINGS

A design example of the object of invention is illustrated in the drawing. It shows.

DETAILED DESCRIPTION OF THE INVENTION

Figure 1:
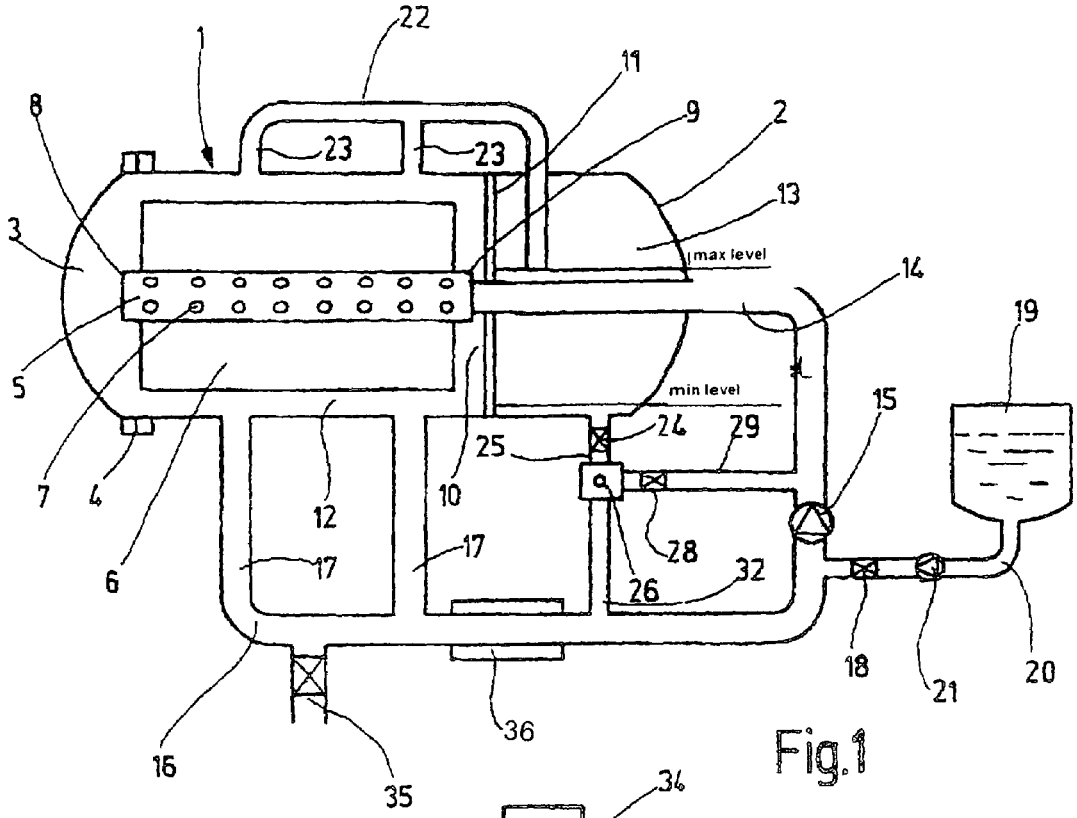
FIG. 1: A beam dyeing machine according the invention in a schematic and principal illustration in longitudinal view.

The piece beam dyeing machine illustrated schematically in FIG. 1 has main vessel 1 designed as a pressure proof vessel or autoclave, which has a cylindrical cross section and in the operating position arranged in a lying position with horizontal longitudinal axis. The main vessel 1 is closed on one side through a dish end bottom 2 and on the other side through a detachable cover 3, which is fastened through the surrounding flange, denoted by 4, with the main vessel 1 in a leak-proof manner during operation. In the main vessel 1, a beam 5, which is being concentrated in this design example, is placed, which carries a cylindrical wound structure composed of the textile products to be treated. The beam 5 can also be placed in an axially displaced manner. The beam 5, in the most useful fashion for the piece beam dyeing machine, consists mainly of a cylindrical perforated tube, the perforations of which on the tube wall are denoted by 7. At its free end 8, the tube is shut. On the opposite end of the tube from the free end, the beam 5, is held (under tube 9) with a holding device 10 of a known design, included in the main vessel 3, in a detachable fashion.

The interior of the main vessel 1 is divided by a separation slab 11, which is leak-proof at the edge side against the vessel inner wall, and aligned right angle to vessel longitudinal axis, in two sections, 12, 13, which does lie in axis direction of the main vessel 3 side by side. The main vessel section 12, sealed through the cover 3 contains the beam 5 with the wound product 6. Its axial length is matched to the length of the beam 5. The other axial shorter main vessel section 13 represents an expansion and retrieval chamber, which is sealed/closed against the main vessel section 12 containing the beam 5. It is restricted through the separation slab 11 and the opposite dished boiler bottom 2 as well as the intermediate shell section of the cylindrical main vessel 1. The main vessel section 13 creating the expansion and retrieval chamber, is crossed by a discharge pipe 14 coaxial to the vessel axis, which is connected to the perforated tube forming the beam. The discharge pipe 14 is connected with the discharge side of a liquor circulation pump 15, and on the suction side a suction pipe 16 is connected which are connected through two adjacent and parallel pipe branches 17 to two positions at the bottom side of the main vessel 1, which in the axis direction of the main vessel 1 are distanced from each other, and form which the main vessel section 12 containing the beam 5 branches out. The suction pipe 16 passes through a heat exchanger, denoted under 36, which allows to maintain the through-flowing processing liquor during the treatment of the textile products forming the wound structure 6 at a temperature necessary for the respective processing step, that means either to heat or cool the processing liquor.

At the suction pipe 16, an additives container 19 is connected through a shut-off valve 18, which contains in watery solution or dispersion of additives for the processing of the textile goods. The additives container 19 is connected with the suction pipe 16 through a connection pipe 20, which includes the shut-off valve 18, in which a retrieval pump 21 is placed, which allows under open shut-off valve 18 to transport the additive from the additives container 19 into the suction pipe 16.

In the upper half of the main vessel 1, an axially running excess flow pipe 22 is provided, which along the upper vertex line of the cylindrical main vessel converges with the main vessel section 12, containing the beam 5, through two pipe branches 23 distanced from each other. At its other end, the excess flow pipe 22 sealed in the expansion and retrieval chamber is led to the other main vessel section 13, where it reaches at least up to a minimum liquor level indicated in FIG. 1, in the vicinity of the cylinder axis of the main vessel 1. Depending upon the length of the beam 5 and the wound structure 6, also several subsidiary pipes 23 can be provided, distributed over the length of the beam 5, which in the axial direction are so distributed that the taps formed by them prevent the development of a residual air bubbles in the upper area of the main vessel under full flooding of the vessel 1.

Figure 2:
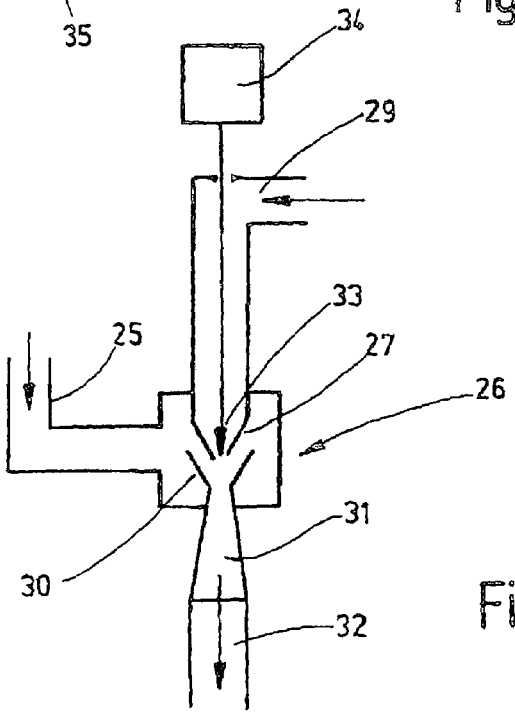
FIG. 2: An injector of the beam dyeing machine as per FIG. 1 in a schematic illustration

From the bottom side of the main vessel section 13 forming the expansion and retrieval chamber, a pipe 25 containing a shut-off valve 24 branches, which lead to an air intake of an injector 26, which is illustrated in a principal design, as an example, in FIG. 2. The drive nozzle 27 of the injector 26 is connected to the discharge side of the liquor circulation pump 15, through pipe 29 containing a shut-off value 28, while the yarn trap 30, with a downstream diffuser 31 where applicable is connected the suction pipe 16 through a pipe 32. The injector 26 can be designed such that it can be controlled. The control tapper denoted under 33 can be adjusted axially where required through a variable drive 34.

A shut-off valve 35 connected the suction pipe 16 enables finally to empty the dyeing machine.

The beam dyeing machine hitherto described as above works as follows:

After bringing in the beam, with the wound structure 6 consisting of several axially one-after-another positioned windings where required, in the main vessel 1, the cover 3 is shut in a leak-proof fashion and the machine is filled, for instance, through valve 35, with the processing liquor. In this context, the main vessel 1 is fully flooded. Through the excess flow pipes 22, also the expansion and retrieval chamber in section 13 of the vessel up to a level higher than the minimum level indicated in FIG. 1, whereby the excess flow pipe 22 reaches below the liquid level, that means dips into the liquid. The excess flow pipe 22 itself is filled similar to the subsidiary pipes 23 with the liquid.

After filling, using the liquor circulation pump 15 the liquor is put in circulation path, which contains the liquor circulation pump 15 and the main vessel 12. In this context, the processed liquor is sucked through the circulation pump 15 through the suction pipe 16 from the boiler. During flowing through the heat exchanger 36, it is either heated or cooled, and the liquor thus brought respectively to the correct processing temperature is conveyed then through the circulation pump 15 and the discharge pipe 14 into the perforated tube of the beam 5. The liquor flows over the textile product of the wound structure 6 through the perforation 7 radially from the bottom to top and is finally again sucked through the suction pipe 16 from the circulation pump.

During this liquor circulation, the main vessel 1 is maintained continuously in a fully flooded condition, while in the expansion and retrieval chamber in section 13 of the vessel, the liquor level is maintained at a level in between the minimum level and the maximum level according to FIG. 1, on which an insulating air cushion is found.

Under open shut-off valve 24, and under running circulation pump 15, the liquor flows in the nozzle 27 of the injector 26, which thereby sucks the liquor from the expansion and retrieval chamber and conveys through the line 32 in the suction pipe 16. In addition to the liquor main circulation loop created by the suction pipe 16, the liquor circulation pump 15, the discharge pipe 14, the beam 5, and the main vessel 1, a limited liquor loop is thus available, which runs through the excess flow pipe 22, the expansion and retrieval chamber in section 13 of the vessel, the injector 26, the main circulation pump 15, the discharge pipe 14 and the beam 5 as well as the main vessel 12, and serves the purpose of continuously circulating the liquor contained in the expansion and retrieval chamber. Typically, through the liquor loop containing the injector 26 somewhat $1/10^{th}$ of the entire liquor if circulated.

If the liquor is heated through the heat exchanger 36, it experiences a volume expansion, which in equal is also valid if additives from the additive container 19 are dosaged in the suction pipe 16 through the additive conveying pump 21. The liquor volume enhanced through expansion and additive materials flows through the excess flow pipe 22 from section 12 into the expansion and retrieval chamber in section 13 separated with the separation slab 11, in which the liquor level correspondingly increases. Using the correspondingly controlled injector 26, this liquor is again re-fed into the main circulation, as explained above.

While under the methodology of working of the beam dyeing machine, the liquor flows on the wound structure 6 radially from inside to outside, through simple liquor reversing measures the beam dyeing machine can be so converted that it works with a reversal of the direction of the flow of the liquor.

Thus the liquor flows on the wound structure 6 from the outside to the inside, which means the suction pipe 16 will be operated as discharge pipe, while the discharge pipe 14 is used as suction pipe. In this context, depending upon the respective processing of the textile product forming wound structure 6, also a choice can be made between flowing of the liquor radially from inside towards the outside and radially from outside to inside, if it should prove necessary or purposeful. Such a reversal of the direction of the liquor flow can be achieved in a simple manner through corresponding liquor controlled devices, for instance, in a manner that the rotation direction of the circulation pump 15 provided for the purpose is reverse driven and/or the circulation pump 15 is provided with the reverse drive pipes and flaps. The injector 26 is substituted in case of the direction reversal of the circulation pump through a reverse drive pump of its own, which also enables to reverse the flow direction of the expansion and retrieval chamber in section 13 of the main vessel.

The principle of dividing the autoclaves formed from main vessel 1 into a processing chamber corresponding to section 12 and an expansion and retrieval chamber corresponding to section 13 is not disturbed by this. As the expansion and retrieval chamber in vessel section 13 is integrated in the main vessel 1, the beam dyeing machine represents a compact design, which requires no special space height in the factory hall, while at the same time a solution, which is cost advantageous in comparison to known design types, emerges. It is to be pointed out that accommodating expansion and retrieval chamber in the main vessel 1 need not necessarily happen in the manner illustrated in FIG. 1 and in the most advantageous manner described above, but design forms are conceivable in which the expansion and retrieval chamber are provided at other positions and/or in other shapes, for instance, in a segment or sector-form in the cylindrical vessel 1. Also, the excess flow pipe 22 need not necessarily run outside of the main vessel 1. Corresponding pipes can also be visualized, at least partially within the main vessel.

In the design form described, the beam dyeing machine, the liquor is fed from the expansion and retrieval chamber in section 13 of the main vessel in a very purpose oriented manner through injector 26 in the main circulation. This leads to a vessel ventilated at all times and thus providing excellent processing, especially dyeing results.

A mention can also be made that the main vessel 1 need not necessarily be designed as a pressure vessel. The invention-based concept can also be used on an atmospheric beam dyeing machine.

Design forms can also be thought of in which the separation slab 15 does not provide liquid-proof division of the main vessel 1. It can, for instance, at its bottom area have openings or can be provided with in its upper area an excess flow edge or piping, which can be accomplished in a pipe sleeve or such other similar item, which can then be placed in the main vessel 1.

The invention claimed is:

1. A beam dyeing machine, comprising:

a vessel that can be closed;

a beam in the vessel, positioned in a withdrawable manner, which is equipped for acceptance of a wound structure made of textile products, and which has at least one perforated tube in the area of its circumference;

a liquor expansion and retrieval chamber which is connected with the inner space of the vessel through excess flow lines, and with a liquor circulation device consisting of a liquor circulation pump, which lies in a liquor circulation loop encompassing the textile beam and the vessel interior; and a pipe branching from the bottom side of the expansion and retrieval chamber;

an injector connected to the pipe branching from the bottom side of the expansion and retrieval chamber, for sucking liquor from the expansion and retrieval chamber; and a pipe for transferring liquor from said injector into the textile beam;

wherein the pipe branching from the bottom side of the expansion and retrieval chamber, the injector, and the pipe for transferring liquor, form a limited liquor circulation loop through the inner space of the vessel; and wherein the excess flow lines and the expansion and retrieval chamber are characterized in that the expansion and retrieval chamber is located directly in a section of the vessel, separated from the section of vessel containing the beam with the wound structure, further characterized in that the liquor circulation loop encompassing the expansion and retrieval chamber contains liquor transport/conveyance devices, and in that the liquor transport devices include said injector, the injection nozzle of which remains connected with discharge side of the liquor circulation pump and is connected at the suction side to the expansion and retrieval chamber.

2. A beam dyeing machine according to claim 1, further characterized in that the expansion and retrieval chamber is located in the axial direction of the vessel adjacent to the section of the vessel containing the beam together with the wound structure.

3. A beam dyeing machine according to claim 2, further characterized in that the expansion and retrieval chamber is liquid-proof sealed from the vessel section containing the beam and the wound structure.

4. A beam dyeing machine according to claim 2, further characterized in that the expansion and retrieval chamber is separated from the vessel section containing the beam and the wound structure by means of a separation wall, which has at least one liquid passage.

5. A beam dyeing machine according to claim 4, further characterized in that the expansion and retrieval chamber is traversed by a liquor line connected to the perforated tube of the beam.

6. A beam dyeing machine according to claim 1, further characterized in that the excess flow line devices are arranged such that they branch from the upper side of the vessel.

7. A beam dyeing machine according to claim 6, further characterized in that the excess flow line devices are arranged such that they extend at least partially outside of the vessel.

8. A beam dyeing machine according to claim 6, is further characterized in that the excess flow line devices are connected to the interior of the vessel at at least two positions distributed over the axial length of the wound structure.

9. A beam dyeing machine according to claim 1, further characterized in that the liquor circulation loop including the liquor circulation pump is provided with a heat exchanger for influencing the temperature of the circulated liquid.

10. A beam dyeing machine according to claim 1, further characterized in that the liquor circulation loop containing the liquor circulation pump includes line devices branching from the vessel and connected with the beam, which is connected to the suction or discharge side of the circulation pump.

11. A beam dyeing machine according to claim 10, is further characterized in that the liquor circulation pump is connected at the suction side with the line devices branching from the vessel and at the discharge side with the beam, and that operationally the liquor flows on the wound structure radially from inner to the outer.

12. A beam dyeing machine according to claim 10, further characterized in that the line devices going into the vessel are impinged with pressure through the liquor circulation pump, and the liquor flows on the wound structure radially from outer to the inner.

* * * * *